US011409217B2

(12) United States Patent
Matsui

(10) Patent No.: US 11,409,217 B2
(45) Date of Patent: Aug. 9, 2022

(54) IMAGE FORMING APPARATUS

(71) Applicant: CANON KABUSHIKI KAISHA, Tokyo (JP)

(72) Inventor: Sho Matsui, Chiba (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/318,134

(22) Filed: May 12, 2021

(65) Prior Publication Data

US 2021/0364965 A1 Nov. 25, 2021

(30) Foreign Application Priority Data

May 19, 2020 (JP) ..... JP2020-087089
Apr. 26, 2021 (JP) ..... JP2021-073843

(51) Int. Cl.
*G03G 15/00* (2006.01)

(52) U.S. Cl.
CPC ..... *G03G 15/50* (2013.01); *G03G 15/657* (2013.01); *G03G 15/6529* (2013.01)

(58) Field of Classification Search
CPC ..... G03G 15/657; G03G 15/6529; G03G 15/2028; G03G 2215/00945; G03G 2215/0129
See application file for complete search history.

(56) References Cited

U.S. PATENT DOCUMENTS

2008/0111297 A1* 5/2008 Fujita ..... B65H 9/002 271/227
2012/0087687 A1* 4/2012 Moteki ..... G03G 15/657 399/68
2018/0009240 A1* 1/2018 Gracia Verdugo ... B41J 11/0085

FOREIGN PATENT DOCUMENTS

JP 2012-83416 A 4/2012
JP 2014-44232 A 3/2014

* cited by examiner

*Primary Examiner* — Jessica L Eley
(74) *Attorney, Agent, or Firm* — Venable LLP

(57) ABSTRACT

An image forming apparatus includes a controller configured to control a conveyance portion to apply a first suction force to a circumferential surface while conveying a sheet from a transfer portion to a fixing portion by a conveyance portion. The controller is configured to execute a first switching process of switching the suction force applied to the circumferential surface from the first suction force to the second suction force while rotating the belt, in a case where a leading end of the sheet has reached the fixing nip portion in a state in which the sheet is nipped by the transfer nip portion.

13 Claims, 9 Drawing Sheets

IMAGE FORMING APPARATUS

BACKGROUND OF THE INVENTION

Field of the Invention

The present invention relates to an image forming apparatus that forms an image on a sheet.

Description of the Related Art

Conventionally, an image forming apparatus of an electrophotographic system includes a transfer portion that transfers an image onto a sheet, and a fixing portion that fixes the image transferred onto the sheet. In addition, as disclosed in Japanese Patent Laid-Open No. 2012-83416, some configurations include a conveyance portion that conveys the sheet on a belt while sucking air to attract the sheet between the transfer portion and the fixing portion in the sheet conveyance direction.

Further, as disclosed in Japanese Patent Laid-Open No. 2014-44232, in some configurations, a loop detection portion is provided between the transfer portion and the fixing portion, and the sheet conveyance speed of the fixing portion is controlled on the basis of detection results.

However, in recent years, the sizes of the transfer portion and the fixing portion have been increased to realize high image quality and high productivity, and therefore the distance between the transfer portion and the fixing portion in which a sheet is conveyed by a conveyance portion has been increased. In this configuration, for example, in the case where loop control is performed on a long sheet that is a thin sheet that is longer than the distance between the transfer portion and the fixing portion and has a small grammage, since the stiffness of the sheet is low, there is a risk that the sheet is separated from the belt at a stretch portion where the belt is stretched while the sheet is attracted to the belt at a suction portion in the sheet conveyance direction, and therefore the behavior of the sheet cannot be stabilized and the loop control cannot be performed.

SUMMARY OF THE INVENTION

The present invention provides an image forming apparatus that performs loop control of a long sheet between a transfer portion and a fixing portion and that can improve the sheet conveyance performance and suppress deterioration of the image quality.

According to one aspect of the present invention, an image forming apparatus includes an image bearing member configured to bear a toner image, a transfer portion including a transfer nip portion configured to nip and convey a sheet, the transfer portion being configured to transfer the toner image born on the image bearing member onto the sheet nipped by the transfer nip portion, a fixing portion including a fixing nip portion configured to nip and convey the sheet, the fixing portion being configured to fix, to the sheet, the toner image transferred onto the sheet by the transfer portion, a conveyance portion including a belt having breathability and an endless shape, a stretching member configured to rotatably stretch the belt, and an air suction portion configured to apply a suction force to a circumferential surface of the belt, the air suction portion being configured to switch the suction force between a first suction force capable of holding the sheet on the circumferential surface and a second suction force that allows the sheet to be separated from the circumferential surface, the conveyance portion being configured to rotate the belt to convey the sheet from the transfer portion toward the fixing portion, and a controller configured to control a sheet conveyance speed of the fixing portion, the suction force of the conveyance portion, and a rotation speed of the belt. The controller is configured to control the conveyance portion to apply the first suction force to the circumferential surface while conveying the sheet from the transfer portion to the fixing portion by the conveyance portion. The controller is configured to execute a first switching process of switching the suction force applied to the circumferential surface from the first suction force to the second suction force while rotating the belt, in a case where a leading end of the sheet has reached the fixing nip portion in a state in which the sheet is nipped by the transfer nip portion.

Further features of the present invention will become apparent from the following description of exemplary embodiments with reference to the attached drawings.

DESCRIPTION OF THE EMBODIMENTS

Exemplary embodiments of the present invention will be described below with reference to drawings.

First Embodiment

Figure 1:
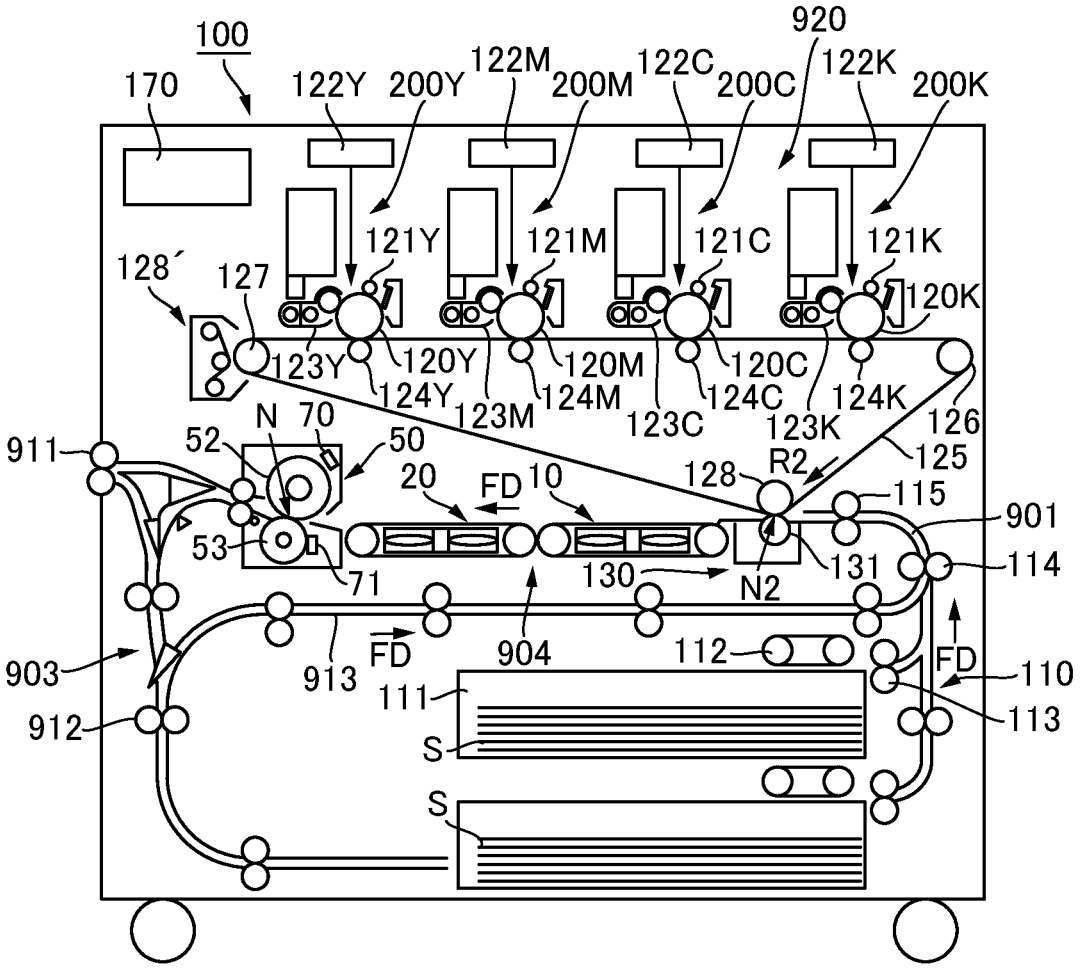
FIG. 1 is a schematic configuration diagram of an image forming apparatus of a first embodiment.

FIG. 1 is a schematic configuration diagram of an image forming apparatus 100 of a first embodiment. First, a configuration of the image forming apparatus 100 will be described with reference to FIG. 1. The image forming apparatus 100 includes a feeding portion 110 that feeds a sheet, an image forming portion 920 that forms a toner image to be fixed to the sheet fed by the feeding portion 110, and a belt conveyance unit 904 that conveys the sheet onto which the toner image has been transferred to a fixing portion 50. Further, the image forming apparatus 100 includes a post-conveyance portion 903 that conveys the sheet to which the toner image has been fixed by the fixing portion 50. The feeding portion 110 includes a sheet cassette 111 that accommodates sheets, pickup rollers 112 that pick up a sheet from the sheet cassette 111, and a separation unit 113 that feeds the sheet picked up by the pickup rollers 112 in a separated state. Further, the feeding portion 110 includes feeding rollers 114 that convey the sheet fed in a separated manner by the separation unit 113 in a feeding path 901, and registration rollers 115. The image forming portion 920 is an image forming portion of a so-called tandem type in which image forming stations 200Y, 200M, 200C, and 200K of an electrophotographic system that respectively form yellow, magenta, cyan, and black toner images are arranged in series. Y, M, C, and K respectively represent yellow, magenta, cyan, and black.

The configurations of the image forming stations 200Y, 200M, 200C, and 200K are the same except for the color of toner therein. Therefore, the configuration of the image forming station 200Y will be described herein as an example, and description of the configurations of the image forming stations 200M, 200C, and 200K will be omitted. To be noted, in FIG. 1, elements of the image forming station 200Y are denoted with a suffix "Y", elements of the image forming station 200M are denoted with a suffix "M", elements of the image forming station 200C are denoted with a suffix "C", and elements of the image forming station 200K are denoted with a suffix "K". The image forming station 200Y includes a photosensitive drum 120Y, a primary charging unit 121Y, an exposing unit 122Y, and a developing unit 123Y. The image forming portion 920 includes an intermediate transfer belt 125 serving as an image bearing member that bears a toner image visualized by the image forming stations 200Y, 200M, 200C, and 200K. The intermediate transfer belt 125 is supported by being stretched over a driving roller 126, a tension roller 127, and a transfer inner roller 128, and rotates in an arrow R2 direction of FIG. 1 by being driven by the driving roller 126.

A secondary transfer roller 131 is in pressure contact with the intermediate transfer belt 125 supported from the inner circumferential side by the transfer inner roller 128, and forms a secondary transfer nip portion N2 between the secondary transfer roller 131 and the intermediate transfer belt 125. The secondary transfer roller 131, the intermediate transfer belt 125, and the transfer inner roller 128 constitute a secondary transfer portion 130 serving as a transfer portion of the present embodiment. A cleaning unit 128' rubs the intermediate transfer belt 125 by a cleaning web and thus removes transfer residual toner, paper dust, and the like remaining on the surface of the intermediate transfer belt 125 after a sheet passes through the secondary transfer nip portion N2. The fixing portion 50 disposed downstream of the secondary transfer portion 130 in a sheet conveyance direction FD is a fixing portion that fixes the toner image to the sheet by heat and pressure. The fixing portion 50 includes a heating roller 52 including a heater therein, and an opposing roller 53 that is disposed so as to be capable of abutting the heating roller 52 to form a fixing nip portion N together with the heating roller 52. In addition, the fixing portion 50 includes a heating roller temperature sensor 70 that detects the surface temperature of the heating roller 52, and a pressurizing roller temperature sensor 71 that detects the surface temperature of the opposing roller 53. The heating roller temperature sensor 70 and the pressurizing roller temperature sensor 71 are respectively provided for maintaining the surface temperature of the heating roller 52 and the surface temperature of the opposing roller 53 at appropriate temperatures.

A belt conveyance unit 904 is disposed between the secondary transfer portion 130 and the fixing portion 50 in the sheet conveyance direction FD. The belt conveyance unit 904 is constituted by a first belt conveyance portion 10 disposed on the upstream side in the sheet conveyance direction FD, and a second belt conveyance portion 20 disposed on the downstream side. The configuration of the belt conveyance unit 904 will be described later.

A post-conveyance portion 903 includes discharge rollers 911 that discharge a sheet discharged from the fixing portion 50 to the outside of the image forming apparatus 100. The post-conveyance portion 903 further includes reverse conveyance rollers 912 that reverse and convey the sheet, and a duplex conveyance path 913 through which the sheet reversed by the reverse conveyance rollers 912 is conveyed into a feeding path 901.

Next, a process of forming an image on a sheet by the image forming apparatus 100 will be described. First, on the basis of an image forming job input to the image forming apparatus 100, the exposing unit 122Y exposes the photosensitive drum 120Y to form an electrostatic latent image on the surface of the photosensitive drum 120Y. The electrostatic latent image on the photosensitive drum 120Y is developed by the developing unit 123Y, and is thus visualized as a toner image. The toner image born on the surface of the photosensitive drum 120Y is transferred onto the intermediate transfer belt 125 by the primary transfer unit 124Y through primary transfer. Toner images born on the surface of the photosensitive drums 120Y, 120M, 120C, and 120K are sequentially transferred onto the intermediate transfer belt 125 so as to be superimposed on one another to form a full-color toner image. The toner image formed on the intermediate transfer belt 125 is transferred, through secondary transfer, onto a sheet S fed from the feeding portion 110 in the secondary transfer nip portion N2 serving as a transfer nip portion of the present embodiment. To be noted, the intermediate transfer belt 125 is rotationally driven by the driving roller 126 rotating at a constant speed, and is thus rotated while the peripheral speed, i.e., rotation speed, thereof is maintained at a constant transfer speed. Therefore, the conveyance speed of the sheet in the secondary transfer nip portion N2 is equal to the peripheral speed of the intermediate transfer belt 125. Hereinafter, the sheet conveyance speed of the secondary transfer portion 130 will be referred to as a "transfer speed VT". The transfer speed VT is a sheet conveyance speed at the time when the toner image is transferred in the secondary transfer portion 130.

The registration rollers 115 receive the sheet S in a state in which the rotation thereof is stopped, and deliver out the sheet S toward the secondary transfer nip portion N2 at a timing matching the conveyance of the toner image on the intermediate transfer belt 125. The sheet S bearing the toner image transferred thereto in the secondary transfer nip portion N2 is conveyed from the secondary transfer nip portion N2 to the fixing portion 50 by the belt conveyance unit 904. In the fixing portion 50, the sheet S is nipped by the fixing nip portion N, and heat and pressure are applied to the unfixed toner image to fix the toner image. The sheet S delivered out from the fixing portion 50 is discharged to the outside of the image forming apparatus 100 by the discharge rollers 911.

In the case of forming an image on each surface of a sheet, the sheet delivered out from the fixing portion 50 is conveyed to the reverse conveyance rollers 912, and reversed and then conveyed by the reverse conveyance rollers 912 toward the duplex conveyance path 913. Then, the sheet is conveyed again to the feeding path 901 through the duplex conveyance path 913, and a toner image is formed on a back surface of the sheet serving as a second surface similarly to a front surface of the sheet serving as a first surface.

Figure 2:
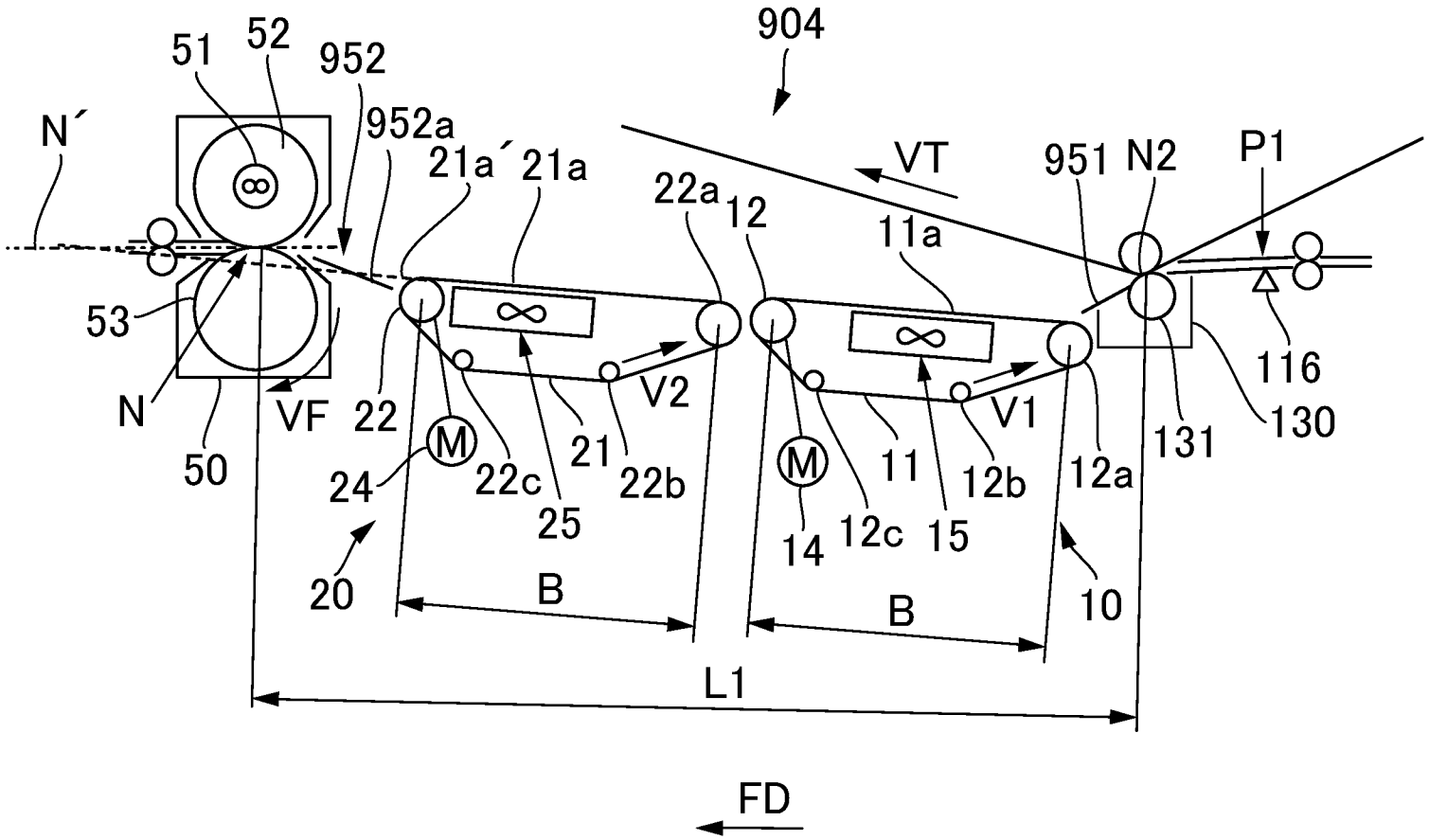
FIG. 2 is a section view of a secondary transfer portion, a belt conveyance unit, and a fixing portion of the first embodiment.

Next, details of the configuration of the belt conveyance unit 904 and the surroundings thereof will be described with reference to FIG. 2. FIG. 2 is a section view of the secondary transfer portion 130, the belt conveyance unit 904, and the fixing portion 50. The belt conveyance unit 904 serving as a conveyance portion of the present embodiment includes the first belt conveyance portion 10 and the second belt conveyance portion 20. The first belt conveyance portion 10 is disposed downstream of the secondary transfer nip portion N2 in the sheet conveyance direction FD, and the second belt conveyance portion 20 is disposed downstream of the first belt conveyance portion 10 and upstream of the fixing nip portion N.

A transfer guide 951 that guides the sheet conveyed from the secondary transfer nip portion N2 toward the belt conveyance unit 904 is provided between the belt conveyance unit 904 and the secondary transfer nip portion N2 in the sheet conveyance direction FD. In addition, a pre-fixation guide 952 that guides the sheet conveyed by the belt conveyance unit 904 toward the fixing nip portion N is provided between the belt conveyance unit 904 and the fixing nip portion N in the sheet conveyance direction FD. As illustrated in FIG. 2, the first belt conveyance portion 10 is positioned below the secondary transfer nip portion N2 as viewed in a sheet width direction perpendicular to the sheet conveyance direction FD. In addition, the second belt conveyance portion 20 is positioned below the fixing nip portion N as viewed in the sheet width direction perpendicular to the sheet conveyance direction FD. As a result of such a configuration, the leading end of the sheet having passed through the secondary transfer nip portion N2 is conveyed toward the first belt conveyance portion 10 along the transfer guide 951.

In addition, the second belt conveyance portion 20 conveys the sheet toward the fixing portion 50 along a sheet conveyance surface 21*a*. A virtual line 21*a*' extending downstream from the sheet conveyance surface 21*a* in the sheet conveyance direction FD intersects with a nip line N' of the fixing nip portion N at a position downstream of the fixing nip portion N in the sheet conveyance direction FD. The nip line N' of the fixing nip portion N is a tangent in contact with the heating roller 52 and the opposing roller 53 among tangents of the fixing nip portion N. As a result of such a configuration, the sheet conveyed on the second belt conveyance portion 20 is conveyed in such a direction as to intersect with the nip line N' from a lower side to a higher side in FIG. 2. Further, the pre-fixation guide 952 serving as a guide member of the present embodiment is provided between the second belt conveyance portion 20 and the fixing portion 50 in the sheet conveyance direction FD. The pre-fixation guide 952 has a guide surface 952*a* that guides the leading end of the sheet conveyed on the sheet conveyance surface 21*a* toward the fixing nip portion N. As viewed in the width direction perpendicular to the sheet conveyance direction FD, the guide surface 952*a* of the pre-fixation guide 952 intersects with the virtual line 21*a*' of the sheet conveyance surface 21*a* at a position downstream of the second belt conveyance portion 20 and upstream of the fixing nip portion N. As a result of such a configuration, the sheet conveyed on the second belt conveyance portion 20 is guided by the pre-fixation guide 952 to the fixing nip portion N while intersecting with the nip line N' from the lower side to the higher side in FIG. 2.

To be noted, the nip line N' of the fixing nip portion N is present in a plane defined by tangents in contact with the heating roller 52 and the opposing roller 53 among tangents of the fixing nip portion N. That is, since the sheet is conveyed to the fixing nip portion N while intersecting with the nip line N' from the lower side to the higher side in FIG. 2, contact between the heating roller 52 and unfixed toner on the sheet can be suppressed.

The first belt conveyance portion 10 includes a first conveyance belt 11 serving as a first belt of the present embodiment, a first driving roller 12 that rotatably stretches the first conveyance belt 11, and driven rollers 12*a*, 12*b*, and 12*c*. The first driving roller 12 and the driven rollers 12*a*, 12*b*, and 12*c* serve as first stretching members of the present embodiment. In addition, the first belt conveyance portion 10 includes a first driving motor 14 that rotates the first driving roller 12 to rotate the first conveyance belt 11. The first conveyance belt 11 is an endless belt provided with numerous holes therein, and is therefore breathable such that air can be communicated between the inner circumferential surface and the outer circumferential surface of the first conveyance belt 11 through the holes. In addition, a first suction fan 15 that sucks air to attract the sheet to the circumferential surface of the first conveyance belt 11 is disposed on the inner circumferential side of the first conveyance belt 11. The first suction fan 15 is capable of sucking air in a direction from the outer circumferential surface to the inner circumferential surface of the first conveyance belt 11 through the numerous holes provided in the first conveyance belt 11 and thus applying a suction force to the circumferential surface of the first conveyance belt 11 to convey the sheet. The first suction fan 15 serves as a first air suction portion of the present embodiment. In addition, among suction forces applied to the circumferential surface of the first conveyance belt 11 by driving the first suction fan 15, a suction force capable of holding the sheet on the circumferential surface of the first conveyance belt 11 serves as a first suction force of the present embodiment. In addition, a suction force that allows the sheet to be separated from the circumferential surface of the first conveyance belt 11 serves as a second suction force of the present embodiment. For example, the suction force capable of holding the sheet on the circumferential surface of the first conveyance belt 11 is strong enough to attract a sheet separated from the circumferential surface of the first conveyance belt 11 to the circumferential surface of the first conveyance belt 11. In addition, the suction force that allows the sheet to be separated from the circumferential surface of the first conveyance belt 11 is, for example, a suction force in which the sheet attracted to the circumferential surface of the first conveyance belt 11 can be separated from the circumferential surface and freely moved. As viewed in the width direction perpendicular to the sheet conveyance direction FD, the sheet having passed through the secondary transfer nip portion N2 is conveyed onto the upper surface of the first conveyance belt 11. As a result of this, the sheet is conveyed in the state of being attracted to the upper surface of the first conveyance belt 11 by the suction force applied to the circumferential surface of the first conveyance belt 11 by the first suction fan 15. In addition, in the present embodiment, the first driving motor 14 is driven such that the sheet conveyance speed V1 of the first conveyance belt 11 is slightly higher than the transfer speed VT. This speed difference between the secondary transfer nip portion N2 and the first conveyance belt 11 suppresses bending of the sheet. To be noted, the sheet conveyance speed V1 of the first conveyance belt 11 is the peripheral speed of the first conveyance belt 11.

The second belt conveyance portion 20 includes a second conveyance belt 21 serving as a second belt of the present embodiment, a second driving roller 22 that rotatably stretches the second conveyance belt 21, and driven rollers 22*a*, 22*b*, and 22*c*. The second driving roller 22 and the driven rollers 22*a*, 22*b*, and 22*c* serve as second stretching members of the present embodiment. In addition, the second belt conveyance portion 20 includes a second driving motor 24 that rotates the second driving roller 22 to rotate the second conveyance belt 21. The second conveyance belt 21 is an endless belt provided with numerous holes therein, and is therefore breathable such that air can be communicated between the inner circumferential surface and the outer circumferential surface of the second conveyance belt 21 through the holes. In addition, a second suction fan 25 that sucks air to attract the sheet to the circumferential surface of the second conveyance belt 21 is disposed on the inner circumferential side of the second conveyance belt 21. To be noted, the second suction fan 25 can be disposed such that the center thereof is positioned downstream of the center of the second conveyance belt 21 in the sheet conveyance direction FD. This allows the sheet to be conveyed to the fixing nip portion N in the state of being close to the sheet conveyance surface 21*a*. The second suction fan 25 is capable of sucking air in a direction from the outer circumferential surface to the inner circumferential surface of the second conveyance belt 21 through the numerous holes provided in the second conveyance belt 21 and thus applying a suction force to the circumferential surface of the second conveyance belt 21 to convey the sheet. The second suction fan 25 serves as a second air suction portion of the present embodiment. In addition, among suction forces applied to the circumferential surface of the second conveyance belt 21 by driving the second suction fan 25, a suction force capable of holding the sheet on the circumferential surface of the second conveyance belt 21 serves as a third suction force of the present embodiment. In addition, a suction force that allows the sheet to be separated from the circumferential surface of the second conveyance belt 21 serves as a fourth suction force of the present embodiment. For example, the suction force capable of holding the sheet on the circumferential surface of the second conveyance belt 21 is strong enough to attract a sheet separated from the circumferential surface of the second conveyance belt 21 to the circumferential surface of the second conveyance belt 21. In addition, the suction force that allows the sheet to be separated from the circumferential surface of the second conveyance belt 21 is, for example, a suction force in which the sheet attracted to the circumferential surface of the second conveyance belt 21 can be separated from the circumferential surface and freely moved. To be noted, the suction force applied to the circumferential surface of the first conveyance belt 11 by the first suction fan 15 and the suction force applied to the circumferential surface of the second conveyance belt 21 by the second suction fan 25 may be set to the same value. As viewed in the width direction perpendicular to the sheet conveyance direction FD, the sheet having passed the first conveyance belt 11 is conveyed onto the upper surface of the second conveyance belt 21. As a result of this, the sheet is conveyed in the state of being attracted to the upper surface of the second conveyance belt 21 by the suction force applied to the circumferential surface of the second conveyance belt 21 by the second suction fan 25. In addition, in the present embodiment, the second driving motor 24 is driven such that the sheet conveyance speed V2 of the second conveyance belt 21 is slightly higher than the sheet conveyance speed V1 of the first conveyance belt 11. The speed difference between the first conveyance belt 11 and the second conveyance belt 21 suppresses bending of the sheet. However, in the case where the first conveyance belt 11, the first driving roller 12, and the driven rollers 12*a*, 12*b*, and 12*c* that constitute the first belt conveyance portion 10 are the same components as the second conveyance belt 21, the second driving roller 22, and the driven rollers 22*a*, 22*b*, and 22*c* that constitute the second belt conveyance portion 20, relative speed variations derived from the tolerance of the parts are almost negligible, and therefore the sheet conveyance speed V1 of the first conveyance belt 11 may be set to be equal to the sheet conveyance speed V2 of the second conveyance belt 21. To be noted, the sheet conveyance speed V2 of the second conveyance belt 21 is the peripheral speed of the second conveyance belt 21.

In addition, a sheet detection sensor 116 that detects the sheet is provided between the registration rollers 115 and the secondary transfer nip portion N2 in the sheet conveyance direction FD. The sheet detection sensor 116 detects the presence or absence of the sheet in a detection position P1 between the registration rollers 115 and the secondary transfer nip portion N2 in the sheet conveyance direction FD. A signal output from the sheet detection sensor 116 is transmitted to a controller 170 illustrated in FIG. 3.

The sheet is conveyed from the second conveyance belt 21 to the fixing portion 50. In the fixing portion 50, for example, the heating roller 52 is rotationally driven by a heating roller driving motor 54 illustrated in FIG. 3. Examples of the heating roller driving motor include a direct current brushless motor. The sheet conveyance speed in the fixing nip portion N is configured to be variable. To be noted, the sheet conveyance speed in the fixing nip portion N is the peripheral speed of the heating roller 52. In the description below, the sheet conveyance speed of the fixing portion 50, that is, the sheet conveyance speed in the fixing nip portion N will be referred to a "fixing speed VF". Here, the fixing speed is the sheet conveyance speed while the toner image is fixed to the sheet in the fixing portion 50. That is, in the fixing nip portion N formed between the heating roller 52 and the opposing roller 53, the toner image is fixed while the sheet is conveyed at the fixing speed VF. To be noted, in the present embodiment, the fixing speed VF is higher than the transfer speed VT. As a result of this, formation of a convex-shaped loop of the sheet above the belt conveyance unit 904 can be suppressed.

In addition, in the present embodiment, a distance L1 between the secondary transfer nip portion N2 and the fixing nip portion N is set to a value equal to or larger than 19 inch=483 mm. In the case of a sheet having a length of 19 inch or less in the sheet conveyance direction FD, the sheet is conveyed without being simultaneously nipped by both of the secondary transfer nip portion N2 and the fixing nip portion N. In addition, the distance between the second suction fan 25 and the fixing nip portion N in the sheet conveyance direction FD is set to such a value that a sheet having a length smaller than a predetermined length in the sheet conveyance direction FD can be conveyed. The sheet shorter than the predetermined length mentioned herein is, for example, a sheet having a length of about 148 mm in the sheet conveyance direction FD, which is a sheet having the minimum length in the sheet conveyance direction FD among sheets that are compatible with the image forming apparatus 100.

In addition, the lengths of the first conveyance belt 11 and the second conveyance belt 21 in the sheet conveyance direction FD are both a length B, that is, the same length. To be noted, although the first conveyance belt 11 and the second conveyance belt 21 are configured in the same manner to use the same parts in the present embodiment, the first conveyance belt 11 and the second conveyance belt 21 may be configured to have different lengths. For example, the length of the first conveyance belt 11 in the sheet conveyance direction FD may be set to 3/10 of the distance L1 between the secondary transfer nip portion N2 and the fixing nip portion N. Further, the length of the second conveyance belt 21 in the sheet conveyance direction FD may be set to ½ of the distance L1 between the secondary transfer nip portion N2 and the fixing nip portion N.

Figure 3:
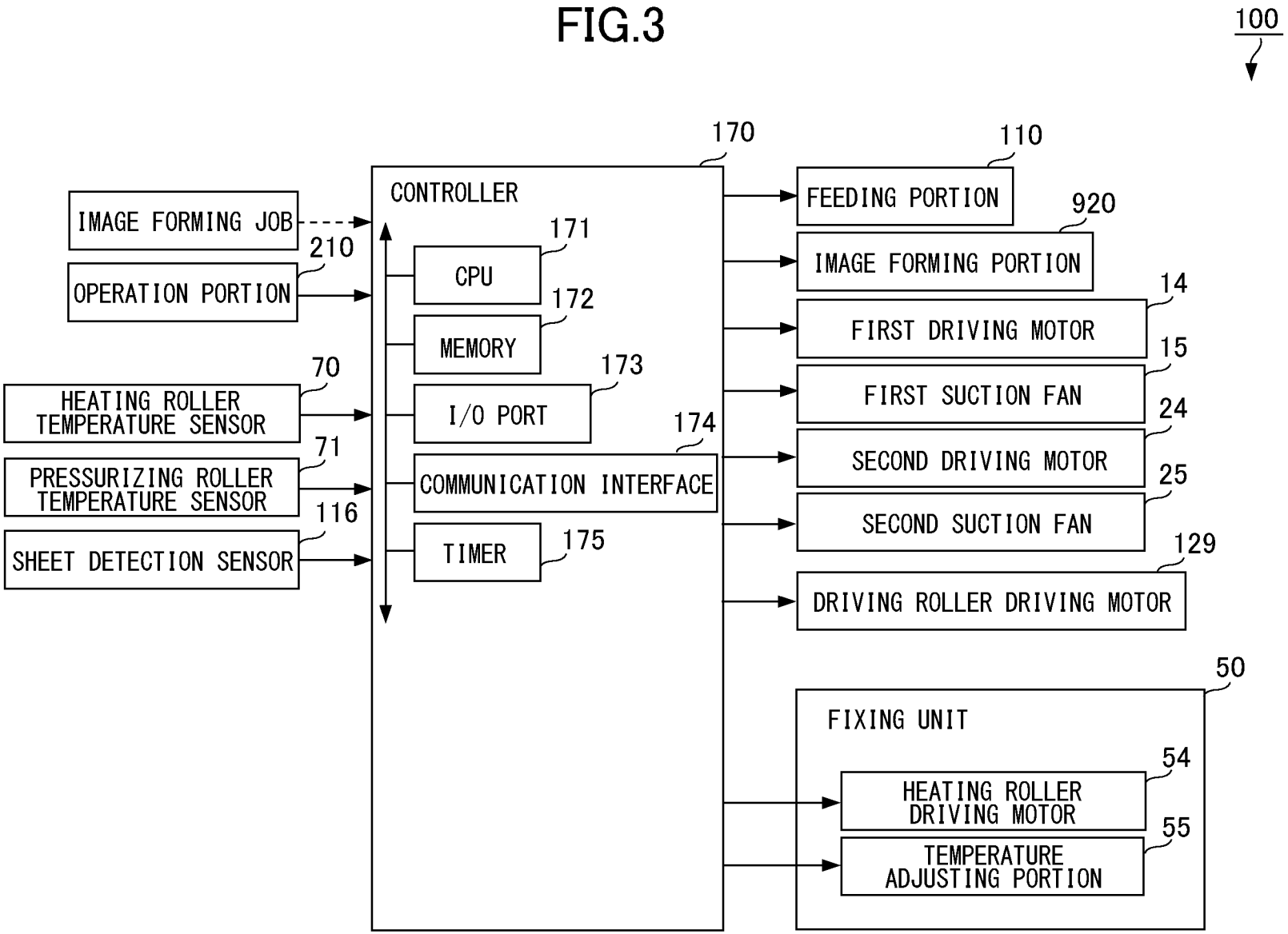
FIG. 3 is a control block diagram of the image forming apparatus of the first embodiment.

Next, a control configuration for conveying the sheet by the belt conveyance unit 904 in the image forming apparatus 100 of the present embodiment will be described with reference to FIG. 3. FIG. 3 is a block diagram illustrating a control configuration of the image forming apparatus 100 of the present embodiment. The controller 170 serving as a controller of the present embodiment includes an arithmetic processing unit including a central processing unit: CPU 171 and a memory 172, an input/output port: I/O port 173, a communication interface 174 serving as a circuit that communicates data with an external device, and so forth. In the controller 170, the CPU 171 loads a plurality of programs stored in the memory 172 and executes the loaded programs, and thus the operation of the image forming apparatus 100 is controlled. The controller 170 controls the feeding portion 110, the image forming portion 920, and so forth in accordance with an image forming job transmitted from an external device. The controller 170 is connected to an operation portion 210, and information about the grammage and size of the sheet, information directly indicating the type of the sheet such as information indicating whether the sheet is a regular paper sheet or a coated paper sheet, or the like is transmitted from the operation portion 210 as information about the type of the sheet. To be noted, the information about the type of the sheet may be included in the information transmitted from the external device as an image forming job. Here, the coated paper sheet is a paper sheet whose surface is coated with resin. In addition, the controller 170 receives signals output from the sheet detection sensor 116, the heating roller temperature sensor 70, and the pressurizing roller temperature sensor 71. On the basis of the received signals, the controller 170 controls the operation of the first driving motor 14, the second driving motor 24, the first suction fan 15, the second suction fan 25, the heating roller driving motor 54, a temperature adjusting portion 55, a driving roller driving motor 129, and so forth.

Figure 4:
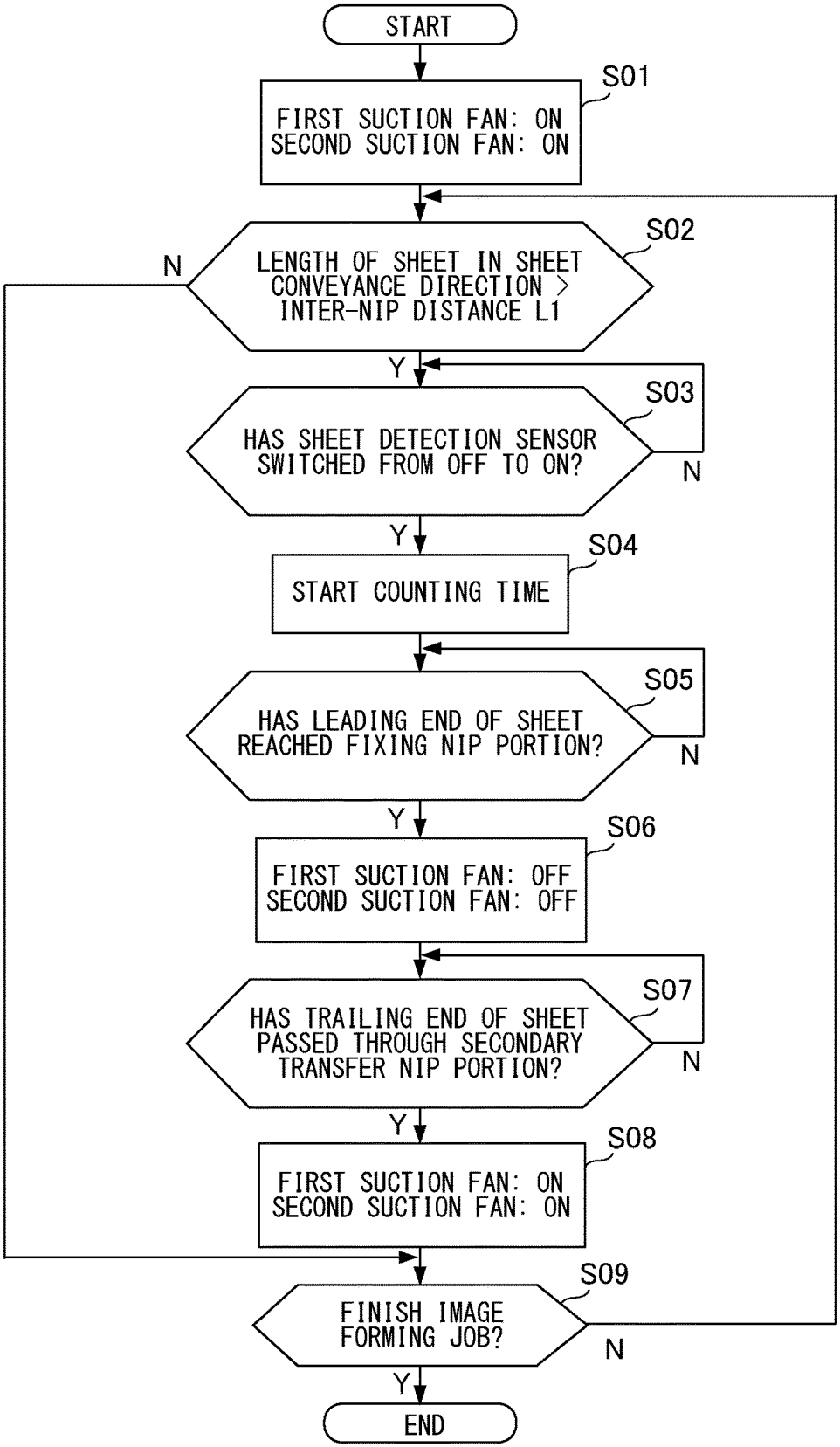
FIG. 4 is a flowchart illustrating a flow of operation of conveying a sheet by the belt conveyance unit of the first embodiment.

Next, a flow of control of the belt conveyance unit 904 in the image forming apparatus 100 of the present embodiment will be described with reference to FIG. 4. FIG. 4 is a flowchart illustrating a flow of operation of conveying the sheet by the belt conveyance unit 904 of the present embodiment. This flow is started when information such as the size and grammage of the sheet in the image forming job is input from the operation portion 210 of the image forming apparatus 100 or when the image forming job is input to the image forming apparatus 100 from an external device. In addition, this flow is executed mainly by the controller 170. When the image forming job is started, the first suction fan 15 of the first belt conveyance portion 10 and the second suction fan 25 of the second belt conveyance portion 20 are driven in step S01.

For example, in the case where the first suction fan 15 is in an OFF state before the image forming job is started, the suction force applied to the circumferential surface of the first conveyance belt 11 is a suction force that allows the sheet to be separated from the first conveyance belt 11. When the first suction fan 15 is driven to an ON state, an airflow from the outer circumferential side to the inner circumferential side of the first conveyance belt 11 is generated, and thus a suction force capable of holding the sheet on the circumferential surface of the first conveyance belt 11 is applied. In addition, for example, in the case where the second suction fan 25 is in an OFF state before the image forming job is started, the suction force applied to the circumferential surface of the second conveyance belt 21 is a suction force that allows the sheet to be separated from the second conveyance belt 21. When the second suction fan 25 is driven to an ON state, an airflow from the outer circumferential side to the inner circumferential side of the second conveyance belt 21 is generated, and thus a suction force capable of holding the sheet on the circumferential surface of the second conveyance belt 21 is applied. To be noted, the OFF state of the first suction fan 15 is not limited to a state in which the operation of the first suction fan 15 is stopped. That is, in the present embodiment, the OFF state of the first suction fan 15 is a state in which a suction force weaker than the suction force capable of holding the sheet, for example, the suction force that allows the sheet to be separated from the first conveyance belt 11 is applied to the circumferential surface of the first conveyance belt 11. In addition, the OFF state of the second suction fan 25 is not limited to a state in which the operation of the second suction fan 25 is stopped. That is, in the present embodiment, the OFF state of the second suction fan 25 is a state in which a suction force weaker than the suction force capable of holding the sheet, for example, the suction force that allows the sheet to be separated from the second conveyance belt 21 is applied to the circumferential surface of the second conveyance belt 21.

Subsequently, in step S02, the controller 170 obtains information about the length of the sheet in the sheet conveyance direction FD from information included in the image forming job, and determines whether or not the length of the sheet is larger than the distance L1 between the secondary transfer nip portion N2 and the fixing nip portion N. In the case where the length of the sheet in the sheet conveyance direction FD is smaller than the distance L1 between the secondary transfer nip portion N2 and the fixing nip portion N, that is, in the case where the result of step S02 is N, an image is formed on the sheet, and the sheet is discharged to the outside of the image forming apparatus 100. Then, in the case where the image forming job is not finished, that is, in the case where the result of step S09 is N, the controller 170 returns to step S02, and in the case where the image forming job is finished, that is, in the case where the result of step S09 is Y, the controller 170 finishes the present flow.

In the case where the length of the sheet in the sheet conveyance direction FD is larger than the distance L1 between the secondary transfer nip portion N2 and the fixing nip portion N in the sheet conveyance direction FD, that is, in the case where the result of step S02 is Y, a standby state is taken in step S03 after starting the conveyance of the sheet until the leading end of the sheet is detected by the sheet detection sensor 116. In the case where the leading end of the sheet has reached the detection position P1 of the sheet detection sensor 116 illustrated in FIG. 2, that is, in the case where the result of step S03 is Y, in step S04, a timer 175 starts counting an elapsed time since the leading end of the sheet has reached the detection position P1. Then, in step S05, the controller 170 determines, on the basis of a count value of the timer 175, whether or not the leading end of the sheet has reached the fixing nip portion N. Specifically, when a signal indicating that the sheet has reached the detection position P1 is received from the sheet detection sensor 116, that is, when a result of Y is obtained for step S03, the controller 170 causes the timer 175 to start counting the elapsed time in step S04. Then, the controller 170 determines, on the basis of the count value of the timer 175, whether or not a first time required for the leading end of the sheet to reach the fixing nip portion N from the detection position P1 has elapsed. Then, in the case where the count value of the timer 175 has reached the first time, the controller 170 determines that the leading end of the sheet has reached the fixing nip portion N, that is, a result of Y is obtained for step S05. To be noted, in the case where the count value of the timer 175 has not reached the first time, that is, in the case where the result of step S05 is N, the controller 170 stands by until the first time elapses. The first time serves as a predetermined time of the present embodiment.

When the leading end of the sheet reaches the fixing nip portion N, the controller 170 switches the first suction fan 15 and the second suction fan 25 from the ON state to the OFF state in step S06. That is, in the case where the leading end of the sheet has reached the fixing nip portion N in a state in which the sheet is nipped by the secondary transfer nip portion N2, the suction force applied to the circumferential surface of the first conveyance belt 11 is reduced as compared with before the leading end of the sheet reaches the fixing nip portion N. In addition, in the case where the leading end of the sheet has reached the fixing nip portion N in a state in which the sheet is nipped by the secondary transfer nip portion N2, the suction force applied to the circumferential surface of the second conveyance belt 21 is reduced as compared with before the leading end of the sheet reaches the fixing nip portion N. The process of switching the first suction fan 15 of the first belt conveyance portion 10 from the ON state to the OFF state serves as a first switching process of the present embodiment. That is, the first switching process can be executed in the case where the length of the sheet in the sheet conveyance direction FD is larger than the distance L1 between the secondary transfer nip portion N2 and the fixing nip portion N.

Then, the controller 170 determines in step S07, on the basis of the count value of the timer 175, whether or not the trailing end of the sheet has passed through the secondary transfer nip portion N2. Specifically, when a signal indicating that the sheet has reached the detection position P1 is received from the sheet detection sensor 116, that is, when a result of Y is obtained in step S03, the controller 170 causes the timer 175 to start counting the elapsed time in step S04. Then, the controller 170 determines, on the basis of the count value of the timer 175, whether or not a second time required for the trailing end of the sheet to pass through the secondary transfer nip portion N2 has elapsed. Then, in the case where the count value of the timer 175 has reached the second time, the controller 170 determines that the trailing end of the sheet has passed through the secondary transfer nip portion N2, that is, a result of Y is obtained for step S07. To be noted, in the case where the count value of the timer 175 has not reached the second time, that is, in the case where the result of step S07 is N, the controller 170 stands by until the second time elapses. To be noted, whether or not the trailing end of the sheet has passed through the secondary transfer nip portion N2 may be determined on the basis of a timing when the signal from the sheet detection sensor 116 is switched from the ON state to the OFF state.

In the case where it has been determined that the trailing end of the sheet has passed through the secondary transfer nip portion N2, the controller 170 switches the first suction fan 15 and the second suction fan 25 to the ON state in step S08. As a result of this, a suction force capable of holding the sheet is applied to the circumferential surface of each of the first conveyance belt 11 and the second conveyance belt 21. The process of switching the first suction fan 15 of the first belt conveyance portion 10 from the OFF state to the ON state serves as a second switching process of the present embodiment. Then, in the case where the image forming job is not finished, that is, in the case where the result of step S09 is N, the controller 170 returns to step S02, and in the case where the image forming job is finished, that is, in the case where the result of step S09 is Y, the controller 170 finishes the present flow.

In the present embodiment, the sheet is conveyed from the secondary transfer portion 130 toward the fixing portion 50 such that fixing speed VF>transfer speed VT holds. That is, in the case where the leading end of the sheet reaches the fixing nip portion N in a state in which the sheet is nipped by the secondary transfer nip portion N2, the sheet is gradually pulled downstream in the sheet conveyance direction FD by the fixing nip portion N. At this time, the suction force applied to the circumferential surface of the first conveyance belt 11 and the second conveyance belt 21 is set to be small so as to suppress sudden displacement of the sheet caused by the suction force on the circumferential surface of the first conveyance belt 11 and the second conveyance belt 21. In this manner, sudden displacement of the sheet can be suppressed also when conveying a so-called long sheet, which is a sheet whose length in the sheet conveyance direction FD is larger than the distance L1 between the secondary transfer nip portion N2 and the fixing nip portion N in the sheet conveyance direction FD. In the present embodiment, suppressing the sudden displacement of the sheet enables suppressing a transfer failure in the secondary transfer portion 130, a conveyance failure of the sheet, and the like, and therefore the sheet conveyance performance and the image quality can be both improved.

Second Embodiment

In the first embodiment, the sheet is conveyed from the secondary transfer portion 130 toward the fixing portion 50 under the condition of fixing speed VF>transfer speed VT. However, the relationship between the fixing speed VF and the transfer speed VT might change depending on the grammage and material of the sheet. In addition, in the case of a so-called long sheet whose length in the sheet conveyance direction FD is 1000 mm or more, the fixing portion 50 pulls the sheet if the fixing speed VF is higher than the transfer speed VT. The nipping force of the fixing portion 50 on the sheet is designed to be larger than the nipping force of the secondary transfer portion 130 on the sheet, for fixing the toner to the sheet. Therefore, the sheet passing through the secondary transfer portion 130 is pulled by the fixing portion 50, and thus a transfer failure of the toner image born on the intermediate transfer belt 125 can occur. In addition, in contrast, in the case where the transfer speed VT is higher than the fixing speed VF, push back of the sheet occurring as a result of the leading end of the sheet abutting the fixing nip portion N can cause the transfer failure of the toner image born on the intermediate transfer belt 125. In addition, in the case where the transfer speed VT is higher than the fixing speed VF, warpage of the sheet, that is, a loop is formed between the secondary transfer portion 130 and the fixing portion 50 in the sheet conveyance direction FD. There is a risk that a damage, conveyance failure, and image defect of the sheet can occur depending on the amount of loop of the sheet between the secondary transfer portion 130 and the fixing portion 50.

In contrast, in the present embodiment, a loop detection portion that detects the loop amount of the sheet at a detection position between the secondary transfer portion 130 and the fixing portion 50 in the sheet conveyance direction FD is provided. As a result of this, the loop amount of the sheet between the secondary transfer portion 130 and the fixing portion 50 can be controlled.

Figure 5:
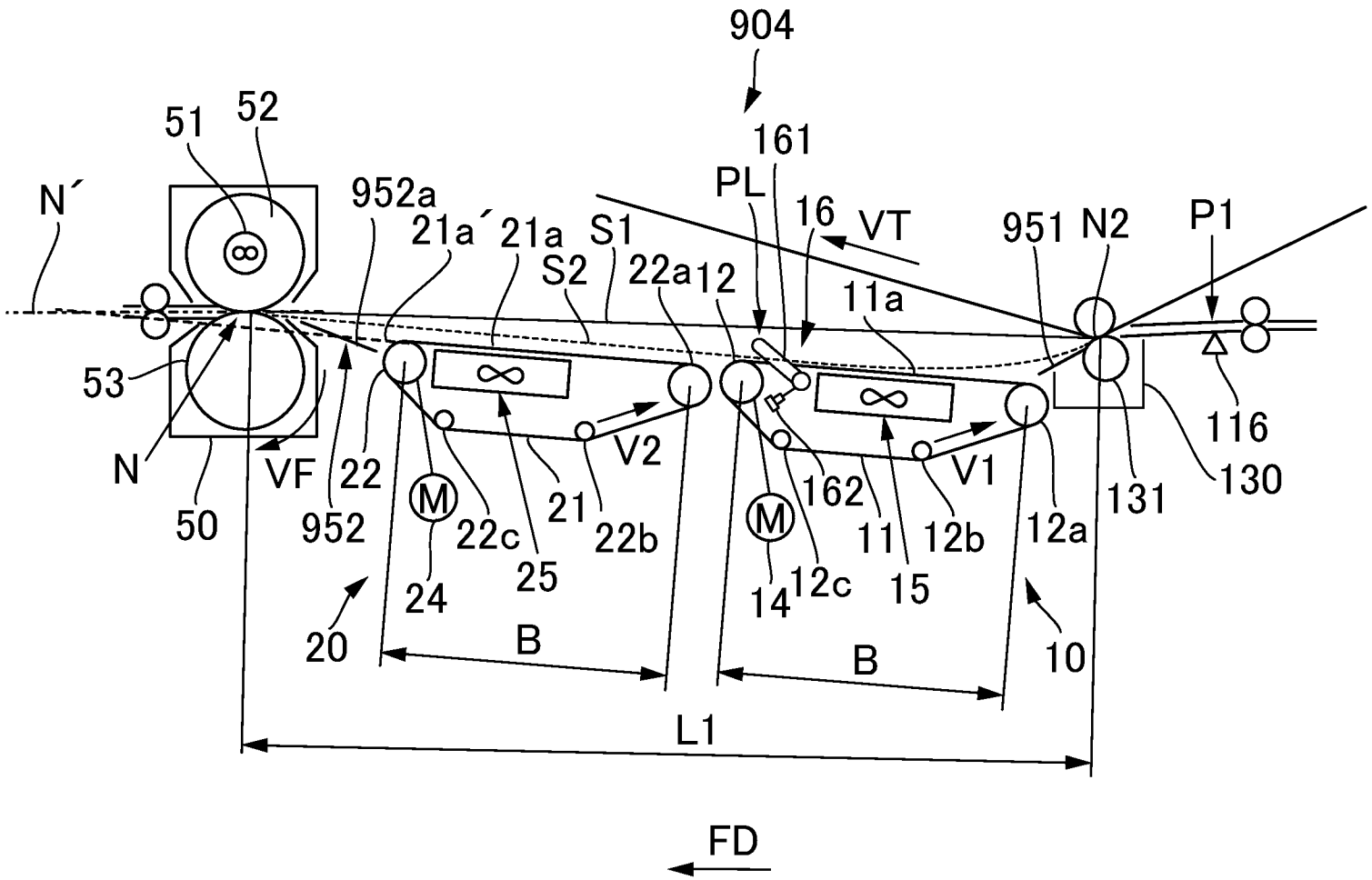
FIG. 5 is a section view of a secondary transfer portion, a belt conveyance unit, and a fixing portion of a second embodiment.

FIG. 5 is a section view of the secondary transfer portion 130, the belt conveyance unit 904, and the fixing portion 50 in the image forming apparatus 100 of the present embodiment. To be noted, the configuration of the image forming apparatus 100 is the same as in the first embodiment illustrated in FIG. 1. In addition, the same elements as in the first embodiment are denoted by the same reference signs in FIG. 5, and redundant description will be omitted. As illustrated in FIG. 5, a loop detection portion 16 is disposed at a position downstream of the first suction fan 15 of the first belt conveyance portion 10 in the sheet conveyance direction FD, and at the center of the belt conveyance unit 904 in the width direction perpendicular to the sheet conveyance direction FD. To be noted, a detection position PL of the loop detection portion 16 of the present embodiment is disposed at a position where the formation of a loop is visualized most, for example, a position slightly downstream of the first suction fan 15 in the sheet conveyance direction FD. However, the detection position PL of the loop detection portion 16 may be any position between the secondary transfer nip portion N2 and the fixing nip portion N in the sheet conveyance direction FD. In addition, in the present embodiment, the detection position PL of the loop detection portion 16 is disposed at a position overlapping with the belt conveyance unit 904 in the sheet conveyance direction FD as viewed in the width direction perpendicular to the sheet conveyance direction FD. As a result of this, the overall loop amount of the sheet in the sheet conveyance direction FD can be detected with high precision.

The loop detection portion 16 includes a loop detection flag 161 that projects from a conveyance surface 11*a* of the first conveyance belt 11, comes into contact with the sheet S conveyed by the belt conveyance unit 904, and swings in accordance with the loop amount of the sheet S. A position where the loop detection flag 161 comes into contact with the sheet S conveyed by the belt conveyance unit 904 serves as an example of the detection position PL of the loop detection portion 16. The loop detection flag 161 serving as a flag member of the present embodiment swings in accordance with the height of the sheet S from the conveyance surface 11*a*. The loop detection portion 16 includes a loop detection sensor 162 illustrated in FIG. 6 such as a photo interrupter that switches between a light blocking state and a non-light blocking state in accordance with the swinging angle of the loop detection flag 161 and outputs an ON signal or an OFF signal. The loop detection sensor 162 is disposed at the middle between a sheet path S1 and a sheet path S2 in a height direction perpendicular to the sheet conveyance direction FD and to the width direction that is also perpendicular to the sheet conveyance direction FD. The sheet path S1 is a conveyance path where the sheet is conveyed at a position the farthest from the conveyance surface 11*a* before the sheet is stretched between the fixing portion 50 and the secondary transfer portion 130 in the sheet conveyance direction FD. In addition, the sheet path S2 is a conveyance path where the sheet is conveyed in the position closest to the conveyance surface 11*a* before the sheet is warped too much between the fixing portion 50 and the secondary transfer portion 130 in the sheet conveyance direction FD. The loop detection sensor 162 switches from the non-light blocking state to the light blocking state and outputs an ON signal when the loop detection flag 161 swings from the center position in the height direction in the sheet path S2 in a direction to approach the conveyance surface 11*a*. The position of the loop detection flag 161 closer to the conveyance surface 11*a* than the center position in the height direction in the sheet path S2 serves as a first position of the present embodiment, and the ON signal serves as a first signal of the present embodiment. In addition, the loop detection sensor 162 switches from the light blocking state to the non-light blocking state and outputs an OFF signal when the loop detection flag 161 swings in a direction to move away from the conveyance surface 11*a* from the center position in the height direction in the sheet path S2. The position of the loop detection flag 161 farther from the conveyance surface 11*a* than the center position in the height direction in the sheet path S2 serves as a second position of the present embodiment, and the OFF signal serves as a second signal of the present embodiment. The loop amount of the sheet when the sheet is conveyed in a direction to move away more from the conveyance surface 11*a* than the sheet path S2 serves as a first amount of the present embodiment. To be noted, the height of the sheet from the conveyance surface 11*a* when the sheet is conveyed in a direction to move away more from the conveyance surface 11*a* than the sheet path S2 serves as a first height of the present embodiment. In addition, the loop amount of the sheet when the sheet is conveyed in a direction to move closer to the conveyance surface 11*a* than the sheet path S2 serves as a second amount of the present embodiment. To be noted, the height of the sheet from the conveyance surface 11*a* when the sheet is conveyed in a direction to move closer to the conveyance surface 11*a* than the sheet path S2 serves as a second height of the present embodiment.

Figure 6:
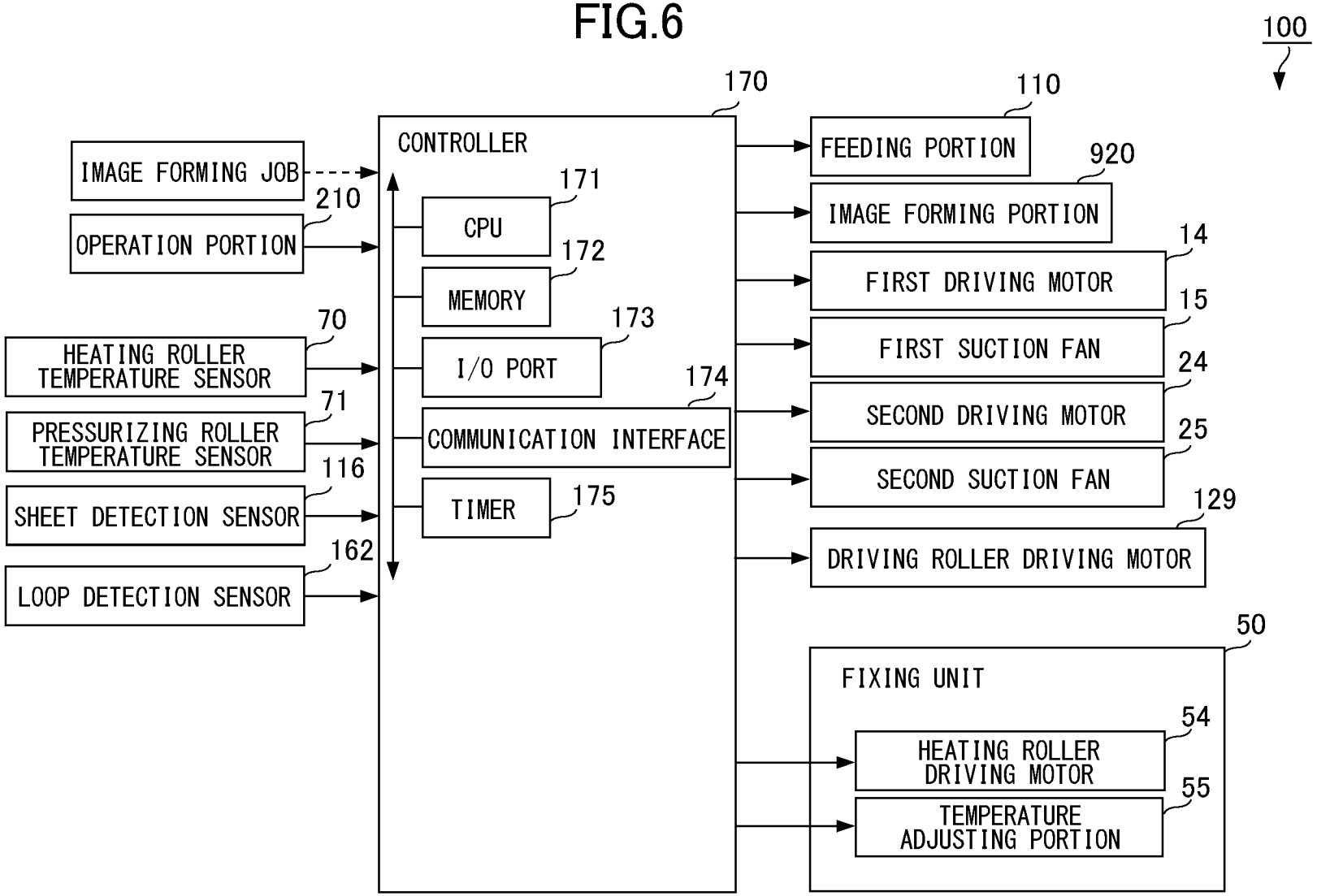
FIG. 6 is a control block diagram of an image forming apparatus of the second embodiment.

Next, the control configuration for conveying the sheet by the belt conveyance unit 904 in the image forming apparatus 100 of the present embodiment will be described with reference to FIG. 6. FIG. 6 is a block diagram illustrating a control configuration of the image forming apparatus 100 of the present embodiment. To be noted, in the description of FIG. 6, the same elements as in the first embodiment illustrated in FIG. 3 will be denoted by the same reference signs, and redundant description will be omitted.

In the present embodiment, a signal output from the loop detection sensor 162 is input to the controller 170. The controller 170 controls the operation of the first driving motor 14, the second driving motor 24, the first suction fan 15, the second suction fan 25, the heating roller driving motor 54, the temperature adjusting portion 55, and so forth on the basis of received signals.

Figure 7:
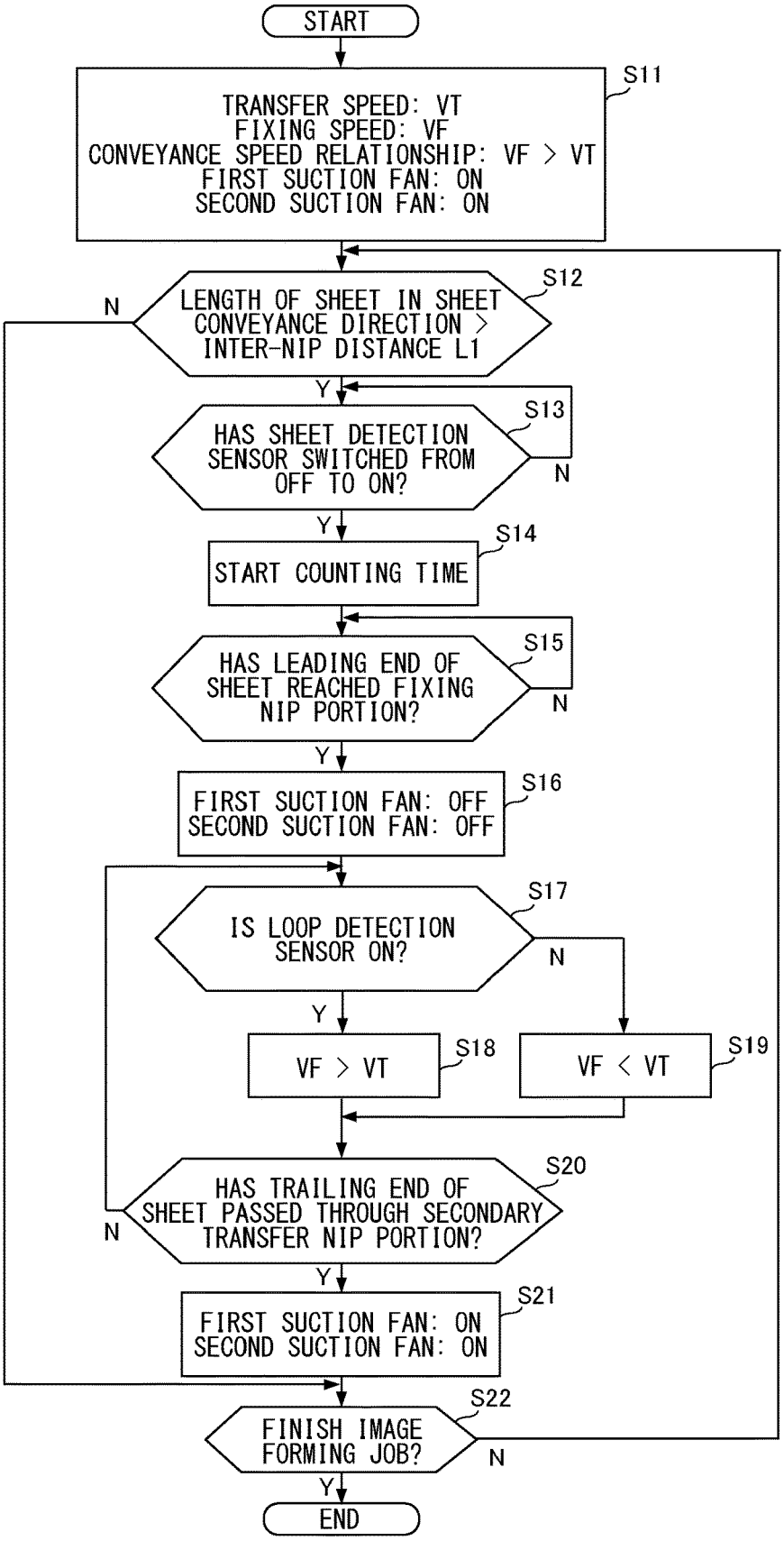
FIG. 7 is a flowchart illustrating a flow of operation of conveying a sheet by the belt conveyance unit of the second embodiment.

Next, the flow of control of the belt conveyance unit 904 in the image forming apparatus 100 of the present embodiment will be described with reference to FIG. 7. FIG. 7 is a flowchart illustrating the flow of operation of conveying the sheet by the belt conveyance unit 904 of the present embodiment. This flow is started when information about the size, grammage, and the like of the sheet in the image forming job is input from the operation portion 210 of the image forming apparatus 100, or when an image forming job is input to the image forming apparatus 100 from an external device. In addition, this flow is mainly executed by the controller 170. When the image forming job is started, the controller 170 performs job starting control in step S11. In the image forming job starting control of the present embodiment, the controller 170 sets the transfer speed VT, the sheet conveyance speed V1 in the first belt conveyance portion 10, the sheet conveyance speed V2 in the second belt conveyance portion 20, and the fixing speed VF to satisfy V2>V1>VT, and VF>VT. Further, the controller 170 controls the heating roller driving motor 54, the first driving motor 14, the second driving motor 24, and the driving roller driving motor 129 such that the conveyance of the sheet is started under the conditions of V2>V1>VT, and VF>VT. To be noted, in the present embodiment, since the fixing speed VF is variable as described above, the relationship of VF>VT might change during execution of the image forming job. In addition, the controller 170 drives the first suction fan 15 of the first belt conveyance portion 10 and the second suction fan 25 of the second belt conveyance portion 20.

For example, in the case where the operation of the first suction fan 15 is in the OFF state before the image forming job is started, the suction force applied to the circumferential surface of the first conveyance belt 11 is a suction force that allows the sheet to be separated from the first conveyance belt 11. When the first suction fan 15 is driven to the ON state, an airflow from the outer circumferential side to the inner circumferential side of the first conveyance belt 11 is generated, and this applies a suction force capable of holding the sheet to the circumferential surface of the first conveyance belt 11. In addition, for example, in the case where the operation of the second suction fan 25 is in the OFF state before the image forming job is started, the suction force applied to the circumferential surface of the second conveyance belt 21 is a suction force that allows the sheet to be separated from the second conveyance belt 21. When the second suction fan 25 is driven to the ON state, an airflow from the outer circumferential side to the inner circumferential side of the second conveyance belt 21 is generated, and this applies a suction force capable of holding the sheet to the circumferential surface of the second conveyance belt 21. To be noted, the OFF state of the first suction fan 15 is not limited to a state in which the operation of the first suction fan 15 is stopped. That is, in the case where a suction force weaker than the suction force capable of holding the sheet, for example, a suction force that allows the sheet to be separated from the circumferential surface of the first conveyance belt 11 is applied to the circumferential surface of the first conveyance belt 11, the first suction fan 15 is in the OFF state in the present embodiment. In addition, the OFF state of the second suction fan 25 is not limited to a state in which the operation of the second suction fan 25 is stopped. That is, in the case where a suction force weaker than the suction force capable of holding the sheet, for example, a suction force that allows the sheet to be separated from the circumferential surface of the second conveyance belt 21, is applied to the circumferential surface of the second conveyance belt 21, the second suction fan 25 is in the OFF state in the present embodiment.

Subsequently, in step S12, the controller 170 obtains information about the length of the sheet in the sheet conveyance direction FD from the information included in the image forming job, and determines whether or not the length of the sheet in the sheet conveyance direction FD is larger than the distance L1 between the secondary transfer nip portion N2 and the fixing nip portion N. In the case where the length of the sheet in the sheet conveyance direction FD is smaller than the distance L1 between the secondary transfer nip portion N2 and the fixing nip portion N, that is, in the case where the result of step S12 is N, an image is formed on the sheet, and the sheet is discharged to the outside of the image forming apparatus 100. Then, in the case where the image forming job is not finished, that is, in the case where the result of step S22 is N, the controller 170 returns to step S12, and in the case where the image forming job is finished, that is, in the case where the result of step S22 is Y, the controller finishes the present flow.

In the case where the length of the sheet in the sheet conveyance direction FD is larger than the distance L1 between the secondary transfer nip portion N2 and the fixing nip portion N, that is, in the case where the result of step S12 is Y, the controller 170 stands by in step S13 until the leading end of the sheet is detected by the sheet detection sensor 116. When the leading end of the sheet reaches the detection position P1 of the sheet detection sensor 116 illustrated in FIG. 5, that is, in the case where the result of step S13 is Y, in step S14, the controller 170 causes the timer 175 to start counting the time elapsed since the leading end of the sheet has reached the detection position P1. Then, in step S15, the controller 170 determines, on the basis of the count value of the timer 175, whether or not the leading end of the sheet has reached the fixing nip portion N. Specifically, when a signal indicating that the sheet has reached the detection position P1 is received from the sheet detection sensor 116, that is, when a result of Y is obtained for step S13, the controller 170 causes the timer 175 to start counting the elapsed time in step S14. Then, the controller 170 determines, on the basis of the count value of the timer 175, whether or not a first time required for the leading end of the sheet to reach the fixing nip portion N from the detection position P1 has elapsed. Then, in the case where the count value of the timer 175 has reached the first time, it is determined that the leading end of the sheet has reached the fixing nip portion N, that is, a result of Y is obtained for step S15. To be noted, in the case where the count value of the timer 175 has not reached the first time, that is, in the case where the result of step S15 is N, the controller 170 stands by until the first time elapses. The first time serves as a predetermined time of the present embodiment.

When the leading end of the sheet reaches the fixing nip portion N, the controller 170 switches the first suction fan 15 from the ON state to the OFF state and the second suction fan 25 from the ON state to the OFF state in step S16. That is, in the case where the leading end of the sheet has reached the fixing nip portion N in a state in which the sheet is nipped by the secondary transfer nip portion N2, the suction force applied to the circumferential surface of the first conveyance belt 11 is reduced as compared with before the leading end of the sheet reaches the fixing nip portion N. In addition, in the case where the leading end of the sheet has reached the fixing nip portion N in a state in which the sheet is nipped by the secondary transfer nip portion N2, the suction force applied to the circumferential surface of the second conveyance belt 21 is reduced as compared with before the leading end of the sheet reaches the fixing nip portion N. The process of switching the first suction fan 15 of the first belt conveyance portion 10 from the ON state to the OFF state serves as a first switching process of the present embodiment. That is, the first switching process can be executed in the case where the length of the sheet in the sheet conveyance direction FD is larger than the distance L1 between the secondary transfer nip portion N2 and the fixing nip portion N.

As described above, in the present embodiment, the fixing speed VF is variable, and therefore the relationship of VF>VT can change during execution of the image forming job. That is, when the leading end of the sheet reaches the fixing nip portion N in a state in which the sheet is nipped by the secondary transfer nip portion N2, the sheet is pulled downstream in the sheet conveyance direction FD by the fixing nip portion N, or a loop of the sheet is formed. At this time, the suction force applied to the circumferential surface of the first conveyance belt 11 and the second conveyance belt 21 is reduced to suppress sudden displacement of the sheet caused by the suction force on the first conveyance belt 11 and the second conveyance belt 21.

When the suction force applied to the circumferential surface of the first conveyance belt 11 and the second conveyance belt 21 is reduced, the controller 170 determines in step S17 the loop amount of the sheet on the basis of a signal received from the loop detection sensor 162. In the case where the loop detection sensor 162 has output an ON signal, that is, in the case where the result of step S17 is Y, the loop detection flag 161 has swung in a direction to move closer to the conveyance surface 11*a* from the center position in the height direction in the sheet path S2. That is, it can be seen that the sheet conveyed on the 11*a* has formed a loop, and is conveyed in the sheet path S2 as illustrated in FIG. 5. In this case, in step S18, the controller 170 changes the relationship between the transfer speed VT and the fixing speed VF to VF>VT by increasing the driving amount of the heating roller driving motor 54. As a result of this, the sheet is pulled toward the fixing portion 50, and the loop formed by the sheet is gradually cancelled, and therefore the loop amount of the sheet being excessive can be suppressed. The sheet conveyance speed in the secondary transfer portion 130, that is, the transfer speed VT serves as a first speed of the present embodiment. In addition, the sheet conveyance speed in the fixing portion 50 higher than the sheet conveyance speed in the secondary transfer portion 130, that is, the fixing speed VF in the case where the relationship between the transfer speed VT and the fixing speed VF is VF>VT, serves as a second speed of the present embodiment.

In contrast, in the case where the loop detection sensor 162 has output an OFF signal, that is, in the case where the result of step S17 is N, the loop detection flag 161 has swung in a direction to move away from the conveyance surface 11*a* from the center position in the height direction in the sheet path S2. That is, it can be seen that the sheet conveyed on the conveyance surface 11*a* has not formed a loop or the loop is small, and the sheet is conveyed in the sheet path S1 as illustrated in FIG. 5. In this case, the controller 170 reduces the driving amount of the heating roller driving motor 54 to change the relationship between the transfer speed VT and the fixing speed VF to VF<VT in step S19. As a result of this, the sheet being excessively pulled toward the fixing portion 50 can be suppressed. The sheet conveyance speed in the fixing portion 50 lower than the sheet conveyance speed in the secondary transfer portion 130, that is, the fixing speed VF in the case where the speed relationship between the transfer speed VT and the fixing speed VF is VF<VT, serves as a third speed of the present embodiment.

Then, in step S20, the controller 170 determines, on the basis of the count value of the timer 175, whether or not the trailing end of the sheet has passed through the secondary transfer nip portion N2. Specifically, the controller 170 causes the timer 175 to start counting time in step S14 when a signal indicating that the sheet has reached the detection position P1 is received from the sheet detection sensor 116, that is, when a result of Y is obtained for step S13. Then, the controller 170 determines, on the basis of the count value of the timer 175, whether or not a second time required for the trailing end of the sheet to pass through the secondary transfer nip portion N2 has passed. Then, in the case where the count value of the timer 175 has reached the second time, it is determined that the trailing end of the sheet has passed through the secondary transfer nip portion N2, that is, a result of Y is obtained for step S20. To be noted, in the case where the count value of the timer 175 has not reached the second time, that is, in the case where the result of step S20 is N, the controller 170 stands by until the second time elapses. To be noted, whether or not the trailing end of the sheet has passed through the secondary transfer nip portion N2 may be determined on the basis of the timing when the signal from the sheet detection sensor 116 is switched from the ON state to the OFF state.

In the case where it has been determined that the trailing end of the sheet has passed through the secondary transfer nip portion N2, the controller 170 switches the first suction fan 15 and the second suction fan 25 to the ON state in step S21. As a result of this, a suction force capable of holding the sheet is applied to the circumferential surface of each of the first conveyance belt 11 and the second conveyance belt 21. The process of switching the first suction fan 15 of the first belt conveyance portion 10 from the OFF state to the ON state serves as a second switching process of the present embodiment. Then, in the case where the image forming job is not finished, that is, in the case where the result of step S22 is N, the controller 170 returns to step S02, and in the case where the image forming job is finished, that is, in the case where the result of step S22 is Y, the controller 170 finishes the present flow.

In the present embodiment, the relationship between the transfer speed VT and the fixing speed VF is changed in accordance with the state of the sheet when the leading end of the sheet has reached the fixing nip portion N in a state in which the sheet is nipped by the secondary transfer nip portion N2. Specifically, in a state in which the sheet is pulled by the fixing nip portion N when the leading end of the sheet reaches the fixing nip portion N, the fixing speed VF is reduced such that the sheet is not excessively pulled toward the fixing portion 50. In addition, in a state in which the loop amount of the sheet when the leading end of the sheet reaches the fixing nip portion N is large, the fixing speed VF is increased to suppress the loop amount of the sheet being excessive. In addition, when detecting the loop amount of the sheet, the suction force applied to the circumferential surface of the first conveyance belt 11 and the second conveyance belt 21 is reduced to suppress sudden displacement of the sheet caused by the suction force on the first conveyance belt 11 and the second conveyance belt 21. As a result of this, the loop amount of the sheet can be detected with higher precision.

As described above, according to the present embodiment, sudden displacement of the sheet or formation of an excessive loop can be suppressed even when conveying a so-called long sheet whose length in the sheet conveyance direction FD is larger than the distance L1 in the sheet conveyance direction FD between the secondary transfer nip portion N2 and the fixing nip portion N. In the present embodiment, a transfer failure in the secondary transfer portion 130, a conveyance failure of the sheet, and so forth can be suppressed by suppressing the sudden displacement of the sheet or formation of an excessive loop, and therefore the sheet conveyance performance and the image quality can be both improved.

Third Embodiment

Figure 8:
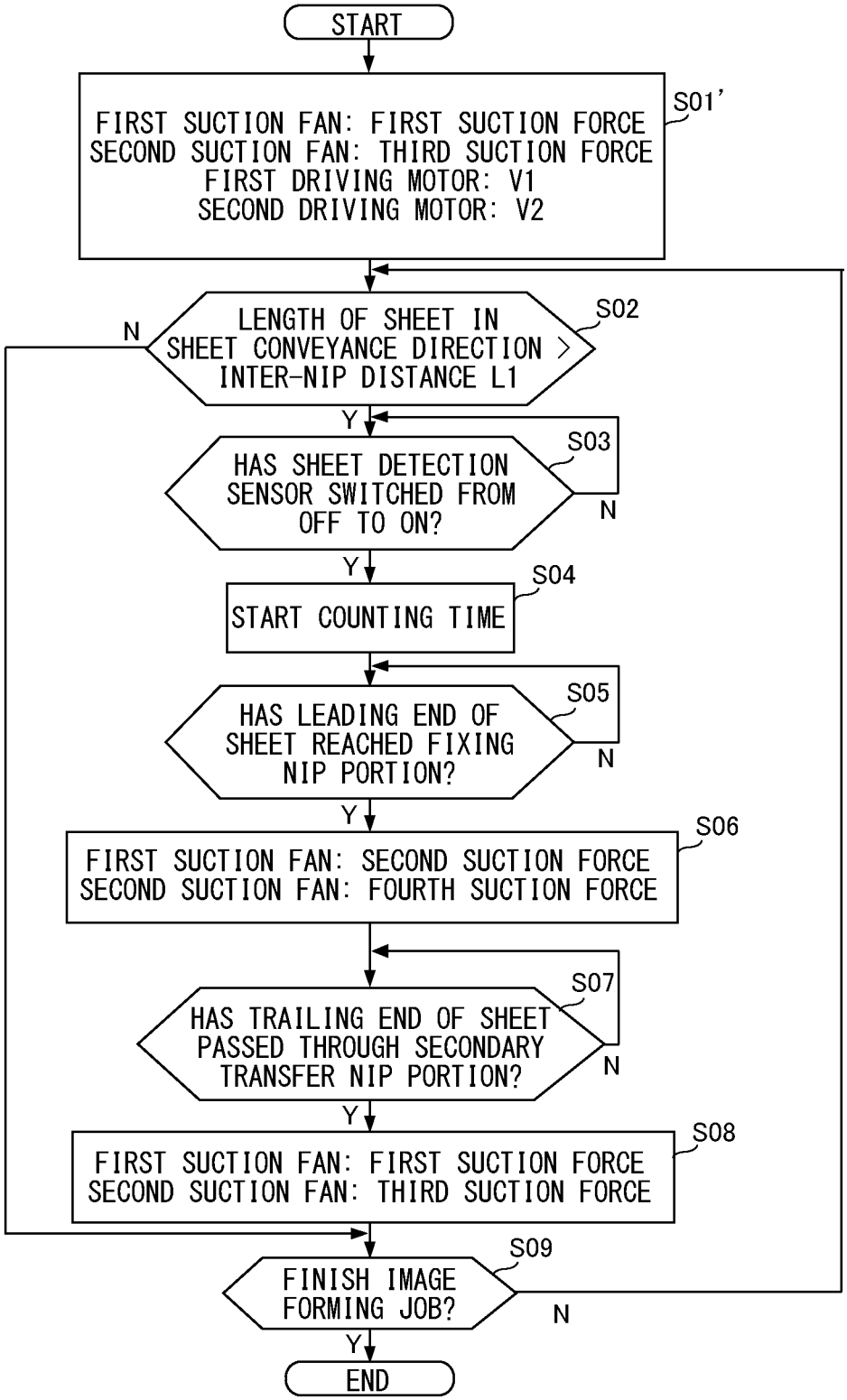
FIG. 8 is a flowchart illustrating a flow of operation of conveying a sheet by the belt conveyance unit of a third embodiment.

In a third embodiment, the suction force of the first suction fan and the second suction fan of the first embodiment is clarified. The other elements are substantially the same as in the first embodiment, and therefore description thereof will be omitted. FIG. 8 is a flowchart illustrating a flow of operation of conveying a sheet by a belt conveyance unit, and this flow is particularly characterized by steps S01' and S06.

When the image forming job is started, in step S01', the first driving motor 14 of the first belt conveyance portion 10 is driven to rotate the first conveyance belt 11 at V1, the first suction fan 15 is driven to apply a first suction force, the second driving motor 24 of the second belt conveyance portion 20 is driven to rotate the second conveyance belt 21 at V2, and the second suction fan 25 is driven to apply a third suction force. At this time, the third suction force is larger than the first suction force. In addition, these suction forces are large enough to attract and convey the sheet on the belts.

When the leading end of the sheet reaches the fixing nip portion N, in step S06, the controller 170 changes the suction force of the first suction fan 15 from the first suction force to a second suction force while driving the first driving motor 14 to rotate the first conveyance belt 11 at V1, and changes the suction force of the second suction fan 25 from the third suction force to the fourth suction force while driving the second driving motor 24 to rotate the second conveyance belt 21 at V2. At this time, the fourth suction force is larger than the second suction force. In addition, the second suction force and the fourth suction force may be the same suction force when the operation of the fans is stopped. That is, the suction forces have the following relationship: first suction force>third suction force>>fourth suction force≥second suction force.

As a result of this, the conveyed sheet and the belts are driven at approximately the same speed, and therefore an image defect caused by transfer of toner soiling or paper dust attached to the belts onto the sheet caused by rubbing between the sheet and the belts can be suppressed.

Fourth Embodiment

Figure 9:
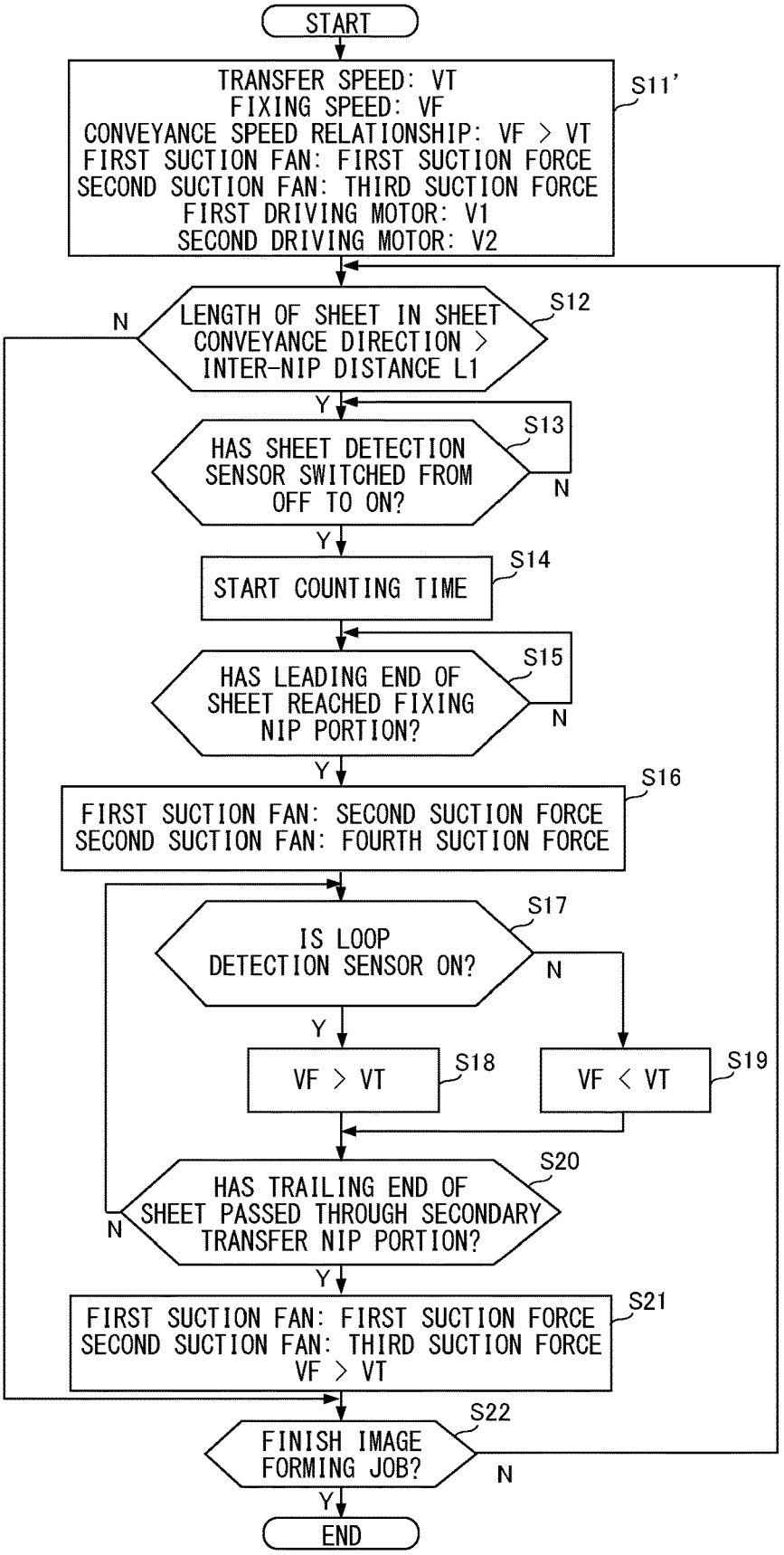
FIG. 9 is a flowchart illustrating a flow of operation of conveying a sheet by the belt conveyance unit of a fourth embodiment.

In a fourth embodiment, the suction force of the first suction fan and the second suction fan and the conveyance speed of belts of the second embodiment are clarified. The other elements are substantially the same as in the second embodiment, and therefore description thereof will be omitted. FIG. 9 is a flowchart illustrating a flow of the operation of conveying a sheet by the belt conveyance unit, and this flow is particularly characterized by steps S11' and S16.

When the image forming job is started, the controller 170 executes the job starting control in step S11'. In the image forming job starting control of the present embodiment, in step S11' the controller 170 drives the first driving motor 14 of the first belt conveyance portion 10 to rotate the first conveyance belt 11 at V1, the first suction fan 15 is driven to apply a first suction force, the second driving motor 24 of the second belt conveyance portion 20 is driven to rotate the second conveyance belt 21 at V2, and the second suction fan 25 is driven to apply a third suction force. At this time, the third suction force is larger than the first suction force.

When the leading end of the sheet reaches the fixing nip portion N, in step S16, the controller 170 changes the suction force of the first suction fan 15 from the first suction force to a second suction force while driving the first driving motor 14 to rotate the first conveyance belt 11 at V1, and changes the suction force of the second suction fan 25 from the third suction force to the fourth suction force while driving the second driving motor 24 to rotate the second conveyance belt 21 at V2. At this time, the fourth suction force is larger than the second suction force. That is, the suction forces have the following relationship: first suction force>third suction force>>fourth suction force>second suction force.

As a result of this, the conveyed sheet and the belts are driven at approximately the same speed, and therefore an image defect caused by transfer of toner soiling or paper dust attached to the belt onto the sheet caused by rubbing between the sheet and the belt can be suppressed.

Other Embodiments

Although an example in which the belt conveyance unit 904 includes the first belt conveyance portion 10 and the second belt conveyance portion 20 has been described in the first and second embodiments, the number of belt conveyance portions included in the belt conveyance unit 904 may be one. For example, only the first belt conveyance portion 10 may be provided. In this case, the first conveyance belt 11 is an endless belt having breathability, the first driving roller 12 and the driven rollers 12*a*, 12*b*, and 12*c* serve as stretching members, and the first suction fan 15 serves as an air suction portion.

In addition, three or more belt conveyance portions may be included in the belt conveyance unit 904. In this case, the sheet conveyance speed of a belt conveyance portion positioned on the more downstream side in the sheet conveyance direction is set to be higher than the sheet conveyance speed of a belt conveyance portion positioned on the more upstream side. As a result of this, bending of the sheet caused by difference in the sheet conveyance speed between belt conveyance portions can be suppressed. In addition, the configurations of the first and second embodiments are also applicable to a printer of a direct transfer system in which toner is directly transferred from a photosensitive drum serving as an image bearing member onto a sheet by a primary transfer roller serving as a transfer portion.

The controller 170 of the first and second embodiments includes the CPU 171 and the memory 172. The CPU 171 reads out and executes a program stored in the memory 172, and works in cooperation with each functional portion that executes a specific function to integrally control the apparatus as will be described later. The memory 172 includes a nonvolatile storage medium such as a read-only memory: ROM, and a volatile storage medium such as a random access memory: RAM, and functions as storage areas for programs and data and work areas for the CPU 171 to execute the programs. In addition, the memory 172 serves as an example of a non-transitory storage medium storing a program for controlling the image forming apparatus 100. To be noted, each function of the controller 170 may be mounted on a circuit of the controller 170 as independent hardware such as an application specific integrated circuit: ASIC, or implemented as software as a functional unit of a program executed by the CPU 171 or another processing unit.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-087089, filed May 19, 2020, and Japanese Patent Application No. 2021-73843, filed Apr. 26, 2021, which are hereby incorporated by reference herein in their entirety.

What is claimed is:

1. An image forming apparatus comprising:

an image bearing member configured to bear a toner image;

a transfer portion comprising a transfer nip portion configured to nip and convey a sheet, the transfer portion being configured to transfer the toner image born on the image bearing member onto the sheet nipped by the transfer nip portion;

a fixing portion comprising a fixing nip portion configured to nip and convey the sheet, the fixing portion being configured to fix, to the sheet, the toner image transferred onto the sheet by the transfer portion;

a conveyance portion comprising:

a belt having breathability and an endless shape;

a stretching member configured to rotatably stretch the belt; and an air suction portion configured to apply a suction force to a circumferential surface of the belt, the air suction portion being configured to switch the suction force between a first suction force capable of holding the sheet on the circumferential surface and a second suction force that allows the sheet to be separated from the circumferential surface, the conveyance portion being configured to rotate the belt to convey the sheet from the transfer portion toward the fixing portion; and a controller configured to control a sheet conveyance speed of the fixing portion, the suction force of the conveyance portion, and a rotation speed of the belt, wherein the controller is configured to control the conveyance portion to apply the first suction force to the circumferential surface while conveying the sheet from the transfer portion to the fixing portion by the conveyance portion, and wherein the controller is configured to execute a first switching process of switching the suction force applied to the circumferential surface from the first suction force to the second suction force while rotating the belt, in a case where a leading end of the sheet has reached the fixing nip portion in a state in which the sheet is nipped by the transfer nip portion.

2. The image forming apparatus according to claim 1 further comprising:

a loop detection portion configured to output a first signal in a case where a loop amount of the sheet at a detection position between the transfer portion and the fixing portion is a first amount, and output a second signal in a case where the loop amount of the sheet at the detection position is a second amount smaller than the first amount, wherein the controller is configured to set a sheet conveyance speed of the transfer portion to a first speed to convey the sheet, to set the sheet conveyance speed of the fixing portion to a second speed higher than the first speed in a case where the first signal has been output from the loop detection portion in a state in which the sheet is nipped by the transfer nip portion and the fixing nip portion, and to set the sheet conveyance speed of the fixing portion to a third speed lower than the first speed in a case where the second signal has been output from the loop detection portion.

3. The image forming apparatus according to claim 2, wherein the controller is configured to set the sheet conveyance speed of the fixing portion to the second speed in a case where a trailing end of the sheet nipped by the transfer nip portion and the fixing nip portion has passed through the transfer nip portion while the sheet conveyance speed of the fixing portion is the third speed.

4. The image forming apparatus according to claim 2, wherein the detection position is a position overlapping with the conveyance portion in a sheet conveyance direction as viewed in a width direction perpendicular to the sheet conveyance direction.

5. The image forming apparatus according to claim 2, wherein the loop detection portion comprises a flag member that is in a first position in a case where a height of the sheet conveyed on the belt from a conveyance surface of the belt at the detection position is a first height, and that is in a second position in a case where the height is a second height lower than the first height, and the loop detection portion outputs the first signal in a case where the flag member is in the first position and the second signal in a case where the flag member is in the second position.

6. The image forming apparatus according to claim 1, wherein the controller is configured to obtain information about a size of the sheet conveyed from the transfer portion toward the fixing portion, and is configured to execute the first switching process in a case where a length of the sheet in the sheet conveyance direction is larger than a distance between the transfer nip portion and the fixing nip portion in the sheet conveyance direction.

7. The image forming apparatus according to claim 1, wherein the controller is configured to execute a second switching process of switching the suction force applied to the circumferential surface from the second suction force to the first suction force in a case where a trailing end of the sheet nipped by the transfer nip portion and the fixing nip portion has passed through the transfer nip portion.

8. The image forming apparatus according to claim 1, wherein the belt, the stretching member, and the air suction portion are respectively a first belt, a first stretching member, and a first air suction portion, wherein the conveyance portion comprises:

a second belt disposed between the first belt and the fixing portion in a sheet conveyance direction and having breathability and an endless shape;

a second stretching member disposed on an inner circumferential side of the second belt and configured to rotatably stretch the second belt; and a second air suction portion configured to apply a suction force to a circumferential surface of the second belt, the second air suction portion being configured to switch the suction force applied to the circumferential surface of the second belt between a third suction force capable of holding the sheet on the circumferential surface of the second belt and a fourth suction force that allows the sheet to be separated from the circumferential surface of the second belt, wherein the controller is configured to start conveying the sheet from the transfer portion toward the fixing portion by the conveyance portion in a state in which the third suction force is applied to the circumferential surface of the second belt and the sheet conveyance speed of the fixing portion is higher than a sheet conveyance speed of the transfer portion, and switch the suction force applied to the circumferential surface of the second belt from the third suction force to the fourth suction force in a case where the leading end of the sheet has reached the fixing nip portion in a state in which the sheet is nipped by the transfer nip portion.

9. The image forming apparatus according to claim 8, wherein a center of the second air suction portion is positioned downstream of a center of the second belt in the sheet conveyance direction.

10. The image forming apparatus according to claim 8, wherein the fixing portion comprises:

a heating roller configured to heat the sheet; and an opposing roller configured to abut the heating roller to form the fixing nip portion, wherein the second belt comprises a sheet conveyance surface which is positioned downstream of the first belt in the sheet conveyance direction and on which the sheet is conveyed, and wherein a virtual line extending downstream from the sheet conveyance surface in the sheet conveyance direction intersects with a nip line at a position downstream of the fixing nip portion in the sheet conveyance direction, the nip line being a tangent in contact with the heating roller and the opposing roller of the fixing nip portion.

11. The image forming apparatus according to claim 10, further comprising a guide member having a guide surface that intersects with the virtual line at a position downstream of the second belt as viewed in a width direction perpendicular to the sheet conveyance direction, and that guides the leading end of the sheet conveyed on the sheet conveyance surface toward the fixing nip portion.

12. The image forming apparatus according to claim 1, further comprising:

a sheet detection portion configured to detect presence or absence of the sheet at a detection position upstream of the fixing nip portion in the sheet conveyance direction, wherein the controller is capable of executing the first switching process in a case where a predetermined time has elapsed since the leading end of the sheet has reached the detection position.

13. The image forming apparatus according to claim 1, wherein a fan of the air suction portion is stopped in a case where the second suction force is applied.

* * * * *